US011642904B2

(12) United States Patent
Breton

(10) Patent No.: US 11,642,904 B2
(45) Date of Patent: May 9, 2023

(54) ELECTRONIC HAND STAMP

(71) Applicant: COLOP Digital GmbH, Wels (AT)

(72) Inventor: Alex Breton, Enskede Gard (SE)

(73) Assignee: COLOP DIGITAL GMBH, Wels (AT)

( * ) Notice: Subject to any disclaimer, the term of this patent is extended or adjusted under 35 U.S.C. 154(b) by 0 days.

(21) Appl. No.: 17/254,184

(22) PCT Filed: Jun. 25, 2019

(86) PCT No.: PCT/EP2019/066805
§ 371 (c)(1),
(2) Date: Dec. 18, 2020

(87) PCT Pub. No.: WO2020/002319
PCT Pub. Date: Jan. 2, 2020

(65) Prior Publication Data

US 2021/0122176 A1 Apr. 29, 2021

(30) Foreign Application Priority Data

Jun. 25, 2018 (EP) ..... 18179493

(51) Int. Cl.
*B41K 1/36* (2006.01)
*B41K 1/00* (2006.01)

(52) U.S. Cl.
CPC ..... *B41K 1/36* (2013.01); *B41K 1/006* (2013.01)

(58) Field of Classification Search
CPC ..... B41K 1/36; B41K 1/006
See application file for complete search history.

(56) References Cited

U.S. PATENT DOCUMENTS 4,947,262 A 8/1990 Yajima et al.
5,634,730 A * 6/1997 Bobry ..... B41J 3/36 346/143
6,062,686 A * 5/2000 Kinoshita ..... B41J 3/36 347/109

(Continued)

FOREIGN PATENT DOCUMENTS

CN 1271916 A 11/2000
CN 1630585 A 6/2005

(Continued)

OTHER PUBLICATIONS

Chinese Office Action for Chinese Patent Application No. 201980040296.0 dated Sep. 15, 2021, 19 pages.

(Continued)

*Primary Examiner* — Christopher E Mahoney
*Assistant Examiner* — Marissa Ferguson-Samreth
(74) *Attorney, Agent, or Firm* — Merchant & Gould P.C.

(57) ABSTRACT

The electronic hand stamp (1) includes an inkjet printhead with nozzles directed toward a bottom side (4) of the electronic hand stamp (1), a control circuit (30) and a motion detector. The control circuit (30) is connected to the motion detector and to the inkjet printhead and configured to control the inkjet printhead in response to readings received from the motion detector. The electronic hand stamp (1) includes at least four indicator LEDs (10-17) connected to the control circuit (30). At least one of the at least four indicator LEDs (10-17) is arranged on every side perpendicular to the bottom side (4) of the electronic hand stamp (1).

18 Claims, 4 Drawing Sheets

(56) References Cited

U.S. PATENT DOCUMENTS

| | | | | |
|---|---|---|---|---|
| 6,769,360 | B2 * | 8/2004 | Walling | B41J 3/36 101/103 |
| 7,426,050 | B2 | 9/2008 | Silverbrook | |
| 7,481,528 | B2 | 1/2009 | Fan et al. | |
| 7,682,017 | B2 * | 3/2010 | Reed | H04N 1/40025 347/108 |
| 7,787,145 | B2 * | 8/2010 | Robertson | B41J 3/44 358/1.12 |
| 2003/0106447 | A1 | 6/2003 | Walling | |
| 2005/0088683 | A1 | 4/2005 | Silverbrook | |
| 2007/0147930 | A1 | 6/2007 | Nishath et al. | |

FOREIGN PATENT DOCUMENTS

| | | | |
|---|---|---|---|
| CN | 202195364 | U | 4/2012 |
| CN | 202698893 | U | 1/2013 |
| CN | 103371718 | A | 10/2013 |
| CN | 103697388 | * | 4/2014 |
| CN | 103697388 | A | 4/2014 |
| CN | 104822986 | A | 8/2015 |
| CN | 206259180 | * | 6/2017 |
| CN | 206259180 | U | 6/2017 |
| DE | 103 53 875 | A1 | 9/2004 |
| DE | 10 2005 014 227 | B4 | 9/2007 |
| WO | 9106929 | * | 5/1991 |

OTHER PUBLICATIONS

International Search Report and Written Opinion of the International Searching Authority for International Patent Application No. PCT/EP2019/066805 dated Aug. 21, 2019, 10 pages.

Extended European Search Report for European Patent Application No. 18179493.4 dated Dec. 19, 2018, 9 pages.

* cited by examiner

ELECTRONIC HAND STAMP

This application is a National Stage Application of PCT/EP2019/066805, filed 25 Jun. 2019, which claims benefit of European Patent Application Serial No. 18179493.4, filed 25 Jun. 2018, and which applications are incorporated herein by reference. To the extent appropriate, a claim of priority is made to each of the above-disclosed applications.

BACKGROUND OF THE INVENTION

The invention concerns an electronic hand stamp and a method for controlling the same. An electronic hand stamp generally is a portable electronic device for producing stamp marks by printing on a substrate (e.g. a document or other object to be stamped). An electronic hand stamp of the present type comprises an inkjet printhead with nozzles directed toward a bottom side of the electronic hand stamp, a control circuit and a motion detector, wherein the control circuit is connected to the motion detector and to the inkjet printhead and configured to control the inkjet printhead in response to readings received from the motion detector, thereby producing a printed image when the electronic hand stamp is manually moved over the substrate.

The present electronic hand stamp can be used as an electronic replacement for traditional (mechanical) hand stamps with rubber stamp plates and ink pads. It transfers a pre-defined image (the motif) to a substrate, which typically already holds information. The information in the motif augments the information already present on the substrate.

For a similar purpose, U.S. Pat. No. 4,947,262 A shows a hand-held manually sweeping printing apparatus. The apparatus has a thermal printer head and a roll of a thermal-transfer ink ribbon. The apparatus comprises three LEDs (light-emitting diodes): a power-supply pilot lamp, a memory pilot lamp and an alarm lamp. Each LED indicates only one binary status. Therefore, each status indicated by one of the LEDs is visible only from one side of the apparatus. In particular, error states or warnings concerning the printer operation might not be recognizable by the user during the printer operation, depending on how the apparatus is positioned and held.

Other portable electronic devices with the ability to print are known, albeit for a different purpose. Specifically, portable printer-scanner devices are known, which serve as a means for replicating existing documents. Such devices typically operate on a first substrate holding information by scanning said information without modifying the first substrate; subsequently they operate on a second substrate that is empty (does not hold information) and print a copy of the scanned information on the second substrate.

Examples of such devices are shown in U.S. Pat. No. 7,426,050 B2, in DE 103 53 875 A1 and in DE 10 2005 014 227 B4.

US 2007/147930 A1 discloses a printing device including light guides to assist the user in aligning the device with a reference, such as the edge of a page.

SUMMARY OF THE INVENTION

It is an object of the present invention, to provide for a reliable user feedback means that can be noticed during operation, thereby facilitating error-free use of the electronic hand stamp.

The invention proposes an electronic hand stamp of the kind stated in the outset, wherein the electronic hand stamp comprises at least four indicator LEDs connected to the control circuit, wherein at least one of the at least four indicator LEDs is arranged on every side perpendicular to the bottom side of the electronic hand stamp. The indicator LEDs are visible from every side or angle. Thus, the information indicated by the indicator LEDs is visible irrespective of the current position of the electronic hand stamp or the grasp thereon.

Correspondingly, the invention proposes a method for controlling an electronic hand stamp as defined above, wherein the at least four indicator LEDs are controlled in an interdependent fashion. In other words, the indicator LEDs are not configured to indicate operationally independent signals, but to cooperate in order to together indicate the same one or more signals concerning the operating status of the electronic hand stamp.

In a preferred embodiment, the electronic hand stamp comprises at least six indicator LEDs, preferably at least eight indicator LEDs, connected to the control circuit. A larger number of indicator LEDs increases the visibility of the indicator LEDs and thus—because they all basically indicate the same information—of the indicated operating status.

Advantageously, the indicator LEDs are multicolour LEDs (e.g. RGB LEDs), wherein the control circuit is configured to control the indicator LEDs to glow in the same colour, in particular either simultaneously or time-delayed (in an animation). By using multicolour LEDs, the number and arrangement of LEDs can be improved compared to a corresponding larger number of single-color LEDs. In particular, a smaller number of LEDs can indicate a comparably larger number of operating statuses by colour-encoding.

The electronic hand stamp may further comprise a diffuser, wherein at least two indicator LEDs are optically connected with the diffuser. The diffuser blurs the gap or limit between two adjacent LEDs; the diffuser typically includes a light guide and a scattering surface. The scattering surface might be formed by a diffusion filter (e.g. milk glass or similar plastics material).

In this context, it is advantageous, if the distance between the indicator LEDs is small enough that the brightness of the LED-light through the diffuser is essentially homogeneous. Essentially homogeneous here means that the brightness of the emitted light does not drop below 70% of the maximum brightness under full-power conditions, optionally the brightness of the emitted light does not drop below 90% of the maximum brightness under full-power conditions.

When all of the at least four indicator LEDs are optically connected with the diffuser, and in particular the diffuser circumferentially surrounds the electronic hand stamp, a continuous light strip can be formed. The light strip may be arranged to surround the outer side walls of the electronic hand stamp.

It has turned out beneficial, if the at least four indicator LEDs are arranged on two or more printed circuit boards (PCBs). Two or more printed circuit boards may preferably be arranged perpendicular to the bottom side of the electronic stamp (i.e. in a vertical arrangement, short "vertical PCB"). Using printed circuit boards as supports for the LEDs has several advantages: they provide a cost effective surface mount process and an easy connection to a control circuit. Rigid PCBs as well as flexible PCBs can be used.

At least one of the PCBs can be a horizontal PCB, wherein the one or more indicator LEDs arranged thereon are right angle LEDs. Moreover, at least one indicator LED can be arranged on a flexible PCB, wherein the flexible PCB is preferably extending from and connected to a vertical PCB.

In a particularly preferred embodiment, the electronic hand stamp comprises at least one target LED (or substrate-lightning LED) for illuminating a print area adjacent the printhead, said at least one target LED being connected to the control circuit. Preferably at least two target LEDs are foreseen, e.g. one on each of opposite sides of the printhead. Illumination of the print area helps in aligning the electronic hand stamp with respect to the substrate, in particular with respect to an existing layout of the substrate (e.g. form fields indicated on a pre-printed paper form).

In this context, the at least two target LEDs are preferably connected to the control circuit, wherein the control circuit is configured to switch on at least one target LED on one of the sides of the printhead, preferably the side corresponding to the direction in which the printhead is being moved. This control of the target LEDs helps to avoid ambiguities concerning the alignment of one of the two sides of the printhead with respect to the substrate. Also, it provides feedback to the user concerning the motion detection performed by the electronic hand stamp by indicating the direction in which the stamp assumes it is moved.

Advantageously, the at least one target LED is optically connected to a prism for deflecting light emitted by the at least one target LED to the print area. The use of a prism allows for the target LED to be supported on the same PCB as one or more of the indicator LEDs, which are configured to emit light not at the print area (facing the bottom side) but to the vertical sides of the electronic hand stamp.

With regard to the inventive method, it is preferred, that the method comprises controlling the at least four indicator LEDs to simultaneously glow in a predefined colour to indicate an operating status of the stamp. For example, the operating status is a member selected from a group consisting of: power-on, battery weak/empty, ink empty, other error, connection established, and transfer finished. The control of the electronic hand stamp can be configured to use different predefined colours, each associated with one of the operating statuses. When the electronic hand stamp reaches an operating status associated with an indication by the indicator LEDs, the indicator LEDs are controlled to all glow in the predefined colour associated with said operating status (e.g. all glowing green upon power-on).

With further regard to the inventive method, the method may particularly comprise controlling the at least four indicator LEDs to glow in a time-delayed fashion and in order of their circumferential arrangement, preferably for at least one turn, to indicate an ongoing operation. For example, the LEDs are controlled to flash at a common frequency and with a phase shift that is larger between more distant LEDs than between adjacent LEDs. To provide an indication that is readily understandable from any side of the electronic hand stamp, it is advantageous, if the flashing of the LEDs and the time delay are configured such that the appearance of a rotating light is created. The ongoing operation can be a member selected from a group consisting of: transfer in progress, and printing in progress. For example, during a transfer of image data from a host device to the electronic hand stamp, the indicator LEDs may be controlled to signal a rotating blue light that stops once the transfer is finished.

With respect to the use of target LEDs, the present method may preferably comprise switching on at least one target LED on one of the sides of the printhead, preferably the side corresponding to the direction in which the printhead is being moved when a direction of movement of the electronic hand stamp is detected, and switching off the other target LEDs.

BRIEF DESCRIPTION OF THE DRAWINGS

Referring now to the drawings, wherein the figures are for purposes of illustrating the present invention and not for purposes of limiting the same, FIG. 1 schematically shows a figurative view of an electronic hand stamp according to the present invention, FIG. 2 schematically shows a partial figurative view of the electronic hand stamp according to FIG. 1 in an opened configuration, FIG. 3 schematically shows a horizontal cut of the electronic hand stamp according to FIGS. 1 and 2.

DETAILED DESCRIPTION OF THE PREFERRED EMBODIMENT

Figure 1:
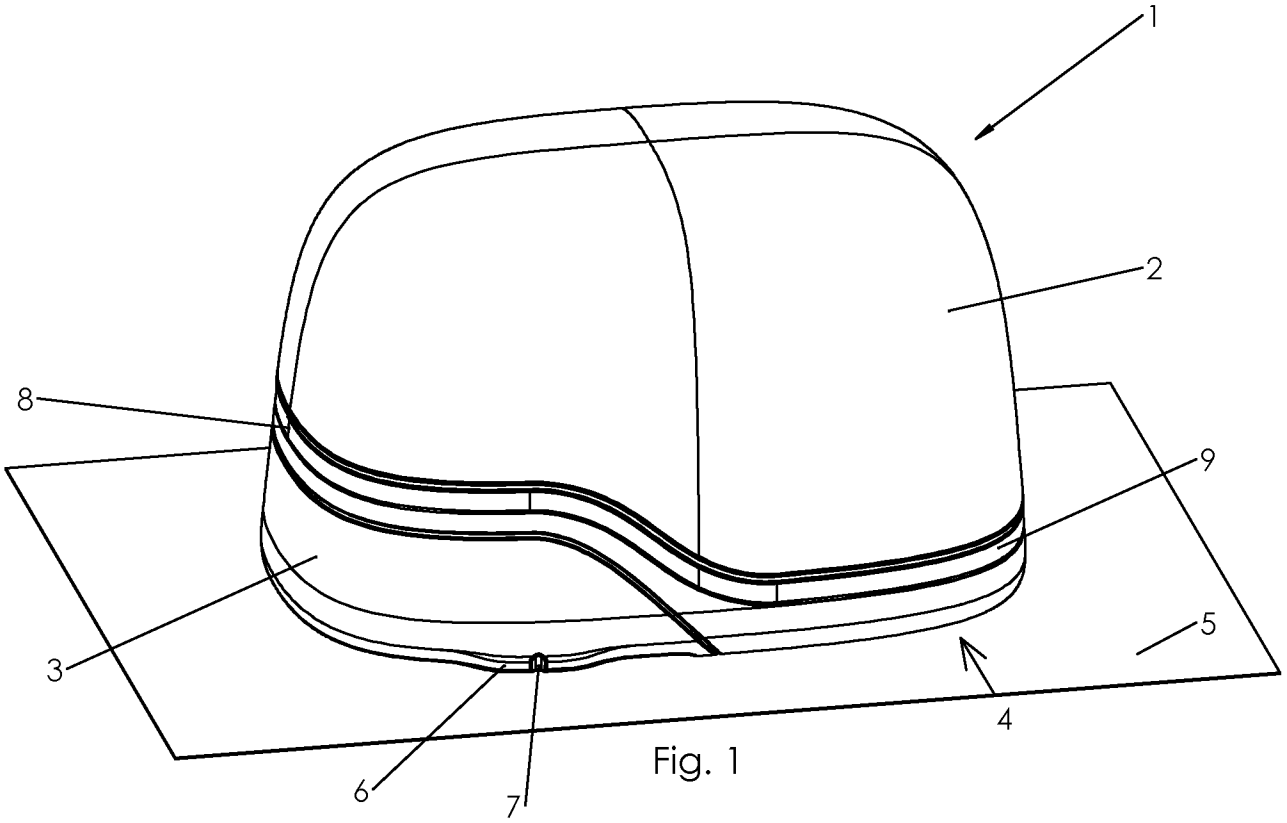

FIG. 1 shows an electronic hand stamp 1 having a generally opaque cover 2 with a windowed portion 3 and a bottom side 4. The windowed portion 3 is made of a transparent material. In the operating position shown in FIG. 1, the electronic hand stamp 1 is positioned with its bottom side 4 flat on a plane substrate 5. In this position, an inkjet printhead (not shown) has its nozzles directed toward the bottom side 4 and the substrate 5 in order to print thereon. The inkjet printhead is controlled by a control circuit 30 (see FIG. 2) integrated in the electronic hand stamp 1. The control circuit 30 is connected to a motion detector, for example an optical sensor directed at the substrate 5, a gyroscope and/or an accelerometer, and configured to received readings from the motion detector and control the inkjet printhead in response to those readings. Specifically, the control is configured to produce an undistorted print image irrespective of a speed of movement of the electronic hand stamp 1 relative to the substrate 5 or variations in said speed. The windowed portion 3 allows a user to supervise the printing process immediately next to the printhead. Extending from the windowed portion 3 of the cover 2, the electronic hand stamp 1 comprises indicator projections 6 on each side (compare FIG. 3). The indicator projections 6 have a central notch 7 marking the centre of the arrangement of nozzles of the inkjet printhead, i.e. on a line connecting the notches 7 of the two indicator projections 6.

Embedded in the cover 2, the electronic hand stamp 1 comprises a light strip 8 (also "light pipe"). The part of the light strip 8 visible on the outside of the assembled electronic hand stamp 1 is a diffuser 9 that circumferentially surrounds the electronic hand stamp 1. The diffuser 9 comprises a diffusion filter 9' having a light scattering surface.

Figure 2:
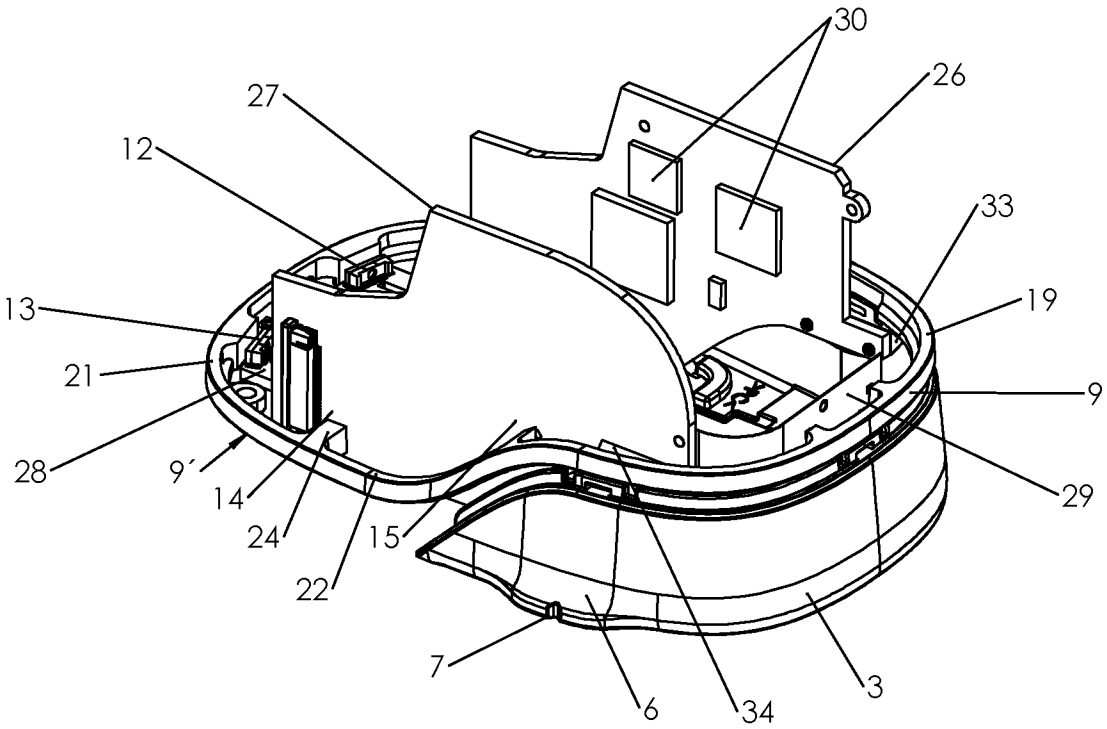
Figure 3:
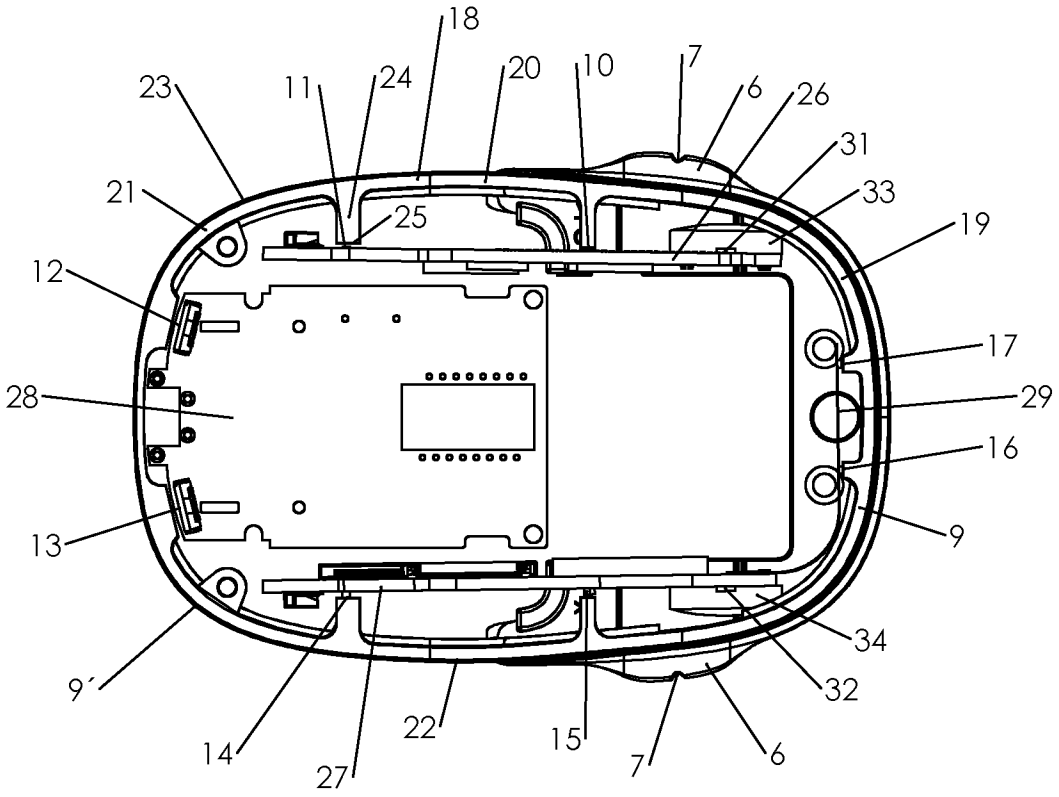

FIGS. 2 and 3 show the other components of the light strip 8. As can be seen, the electronic hand stamp 1 comprises eight indicator LEDs 10, 11, 12, 13, 14, 15, 16, 17. Two indicator LEDs 10, 11; 12, 13; 14, 15; 16, 17 are arranged on every side of the electronic hand stamp 1 perpendicular to the bottom side 4. All eight indicator LEDs 10-17 are optically connected with a light guide 18 of the diffuser 9. The light guide 18 comprises four segments 19-22, each connected to one or more of the indicator LEDs 10-17. More specifically, the segments 19-22 of the light guide 18 together define a continuous outer surface 23, on which the diffusion filter 9' of the diffuser 9 is attached. The diffusion filter 9' may be for example a scattering foil adhered to the continuous outer surface 23. The segments 19-22 comprise a main portion that is parallel to the continuous outer surface 23 and from which legs 24 extend to each of the connected indicator LEDs 10-17. Each leg 24 at its end facing the respective indicator LED 10-17 has a flat end surface 25 that is perpendicular to the principal direction of light emitted from the respective indicator LED 10-17. This arrangement provides for an efficient coupling of light into the light guide 18.

The distance between the indicator LEDs 10-17 is small enough that the brightness of the LED-light through the diffuser 9 is essentially homogeneous. The homogeneous distribution of light is achieved by total internal reflection in the light guide 18 and partial back scattering from the diffusion filter 9' into the light guide 18. The scattering of the light can optionally be improved by using a material which contains scattering particles for the light guide 18. However, a homogeneous distribution can also be achieved without scattering, a scattering surface or scattering particles. Hence, it is those two elements and their respective optical properties that define the number of indicator LEDs required to homogeneously illuminate or "supply" a given length of the light strip 8. Another influence is the optical coupling between adjacent segments 19-22 of the light guide 18 parallel to the continuous outer surface 23.

The indicator LEDs 10-17 are arranged on two vertical printed circuit boards (PCBs) 26, 27, one horizontal PCB 28 and one flexible PCB 29 extending from one of the vertical PCBs 27. All indicator LEDs 10-17 are connected to a common control circuit 30 arranged on one or more of the PCBs 26. Accordingly, all PCBs 26-29 are electronically connected, e.g. with a common bus system. The indicator LEDs 12, 13 arranged on the horizontal PCB 28 are right angle LEDs, i.e. having a principal light emission direction parallel to the principal plane of the horizontal PCB 28. All eight indicator LEDs 10-17 are multicolour LEDs. The control circuit 30 is configured to control the indicator LEDs 10-17 in an interdependent fashion, for example to glow in the same colour, in particular either simultaneously or time-delayed.

In addition to the indicator LEDs 10-17, the electronic hand stamp 1 comprises two target LEDs 31, 32, one on each of the vertical PCBs 26, 27. The target LEDs 31, 32 are bright white-light LEDs that are each optically connected to a respective prism 33, 34 for deflecting light emitted by the associated target LED 31, 32 to the print area on the substrate 5 adjacent the printhead, thereby illuminating the print area. The target LEDs 31, 32 are connected to the control circuit 30 of the electronic hand stamp 1. The control circuit 30 is configured to switch on the target LED 31; 32 on the side of the printhead corresponding to the direction in which the printhead is being moved (according to the reading of the motion sensor).

Figure 4:
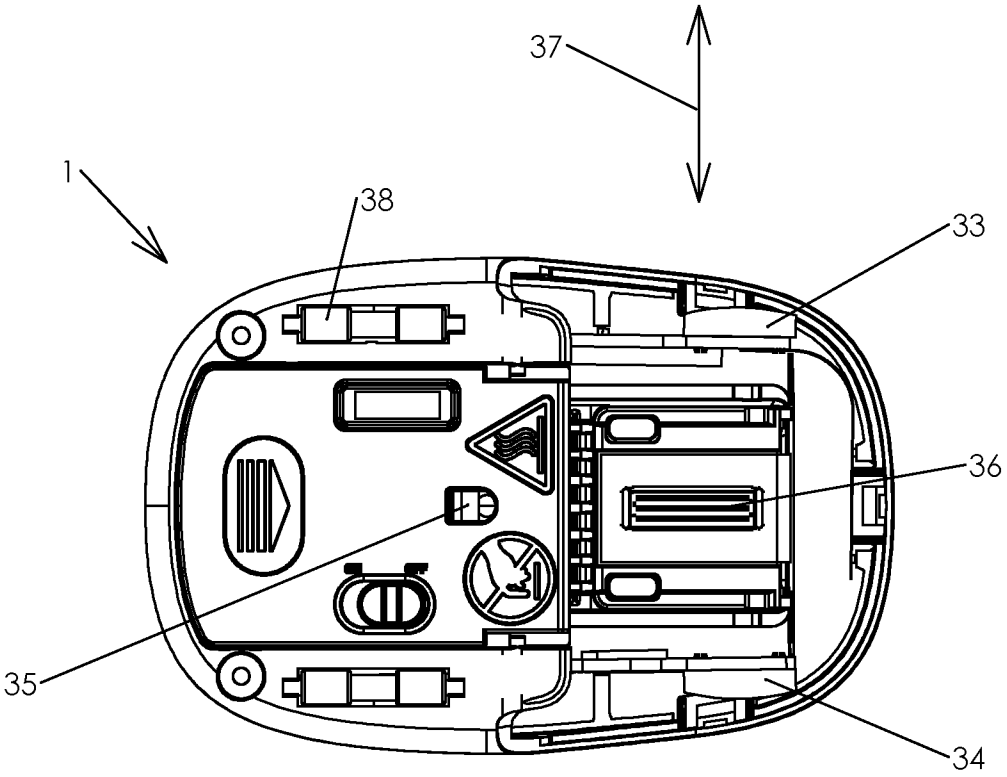
FIG. 4 shows a bottom view of the electronic hand stamp according to the previous figures.

FIG. 4 shows a view from below onto the bottom side 4 of the electronic hand stamp 1. The printhead 36 is positioned essentially centred between the prisms 33, 34 of the target LEDs 31, 32. Motion of the electronic hand stamp 1 is detected with an optical motion detector 35, which is in principle similar to detectors used for optical computer mice. During printing, the electronic hand stamp 1 is moved in one or the other direction along an essentially linear axis of motion 37. A row of inkjet nozzles of the printhead 36 is arranged perpendicular to the axis of motion 37. The rollers 38 guide and help to maintain a straight path of movement during printing, i.e. along the axis of motion 37.

The invention claimed is:

1. An electronic hand stamp comprising:

a bottom side;

an inkjet printhead with nozzles directed toward the bottom side;

a control circuit;

a motion detector, wherein the control circuit is connected to the motion detector and to the inkjet printhead and configured to control the inkjet printhead in response to readings received from the motion detector;

at least four indicator LEDs connected to the control circuit, wherein the at least four indicator LEDs indicate an operating status of the electronic hand stamp, and wherein at least one of the at least four indicator LEDs is arranged on each of four sides of the electronic hand stamp perpendicular and adjacent to the bottom side; and a diffuser and all of the at least four indicator LEDs are optically connected with the diffuser;

wherein the control circuit is configured to control interdependently the at least four indicator LEDs to together indicate one or more same signals concerning the operating status of the electronic hand stamp.

2. The electronic hand stamp according to claim 1, wherein the electronic hand stamp comprises at least six indicator LEDs connected to the control circuit.

3. The electronic hand stamp according to claim 2, wherein the electronic hand stamp comprises at least eight indicator LEDs connected to the control circuit.

4. The electronic hand stamp according to claim 1, wherein the indicator LEDs are multicolor LEDs, wherein the control circuit is configured to control the indicator LEDs to glow in the same color.

5. The electronic hand stamp according to claim 4, wherein the control circuit is configured to control the indicator LEDs to glow in the same color either simultaneously or time-delayed.

6. The electronic hand stamp according to claim 1, wherein the distance between the indicator LEDs is small enough that brightness of LED light through the diffuser is substantially homogeneous.

7. The electronic hand stamp according to claim 1, wherein the diffuser circumferentially surrounds the electronic hand stamp.

8. The electronic hand stamp according to claim 1, wherein the at least four indicator LEDs are arranged on two or more printed circuit boards.

9. The electronic hand stamp according to claim 1, wherein the electronic hand stamp comprises at least one target LED for illuminating a print area adjacent the printhead, wherein the at least one target LED is connected to the control circuit.

10. The electronic hand stamp according to claim 9, wherein the electronic hand stamp comprises at least two target LEDs for illuminating a print area adjacent the printhead, wherein the at least two target LEDs are connected to the control circuit.

11. The electronic hand stamp according to claim 10, wherein the control circuit is configured to switch on at least one target LED on one of the sides of the printhead.

12. The electronic hand stamp according to claim 11, wherein the control circuit is configured to switch on at least one target LED on a side of the printhead corresponding to a direction in which the printhead is being moved.

13. A method for controlling the electronic hand stamp according to claim 11, comprising switching on at least one target LED on one of the sides of the printhead when a direction of movement of the electronic hand stamp is detected, and switching off the other target LEDs.

14. The method for controlling an electronic hand stamp according to claim 13, comprising switching on at least one target LED on the side of the printhead corresponding to the direction in which the printhead is being moved when a direction of movement of the electronic hand stamp is detected, and switching off the other target LEDs.

15. The electronic hand stamp according to claim 9, wherein the at least one target LED is optically connected to a prism for deflecting light emitted by the at least one target LED to the print area.

16. A method for controlling the electronic hand stamp according to claim 1, comprising controlling the at least four indicator LEDs in an interdependent fashion and to glow in a time-delayed fashion and in order of circumferential arrangement to indicate an ongoing operation.

17. The method according to claim 16, comprising controlling the at least four indicator LEDs to glow in a time-delayed fashion and in the order of circumferential arrangement for at least one turn to indicate an ongoing operation.

18. An electronic hand stamp comprising:

a bottom side;

an inkjet printhead with nozzles directed toward the bottom side;

a control circuit;

a motion detector, wherein the control circuit is connected to the motion detector and to the inkjet printhead and configured to control the inkjet printhead in response to readings received from the motion detector;

at least four indicator LEDs connected to the control circuit, wherein at least one of the at least four indicator LEDs is arranged on each of four sides of the electronic hand stamp perpendicular and adjacent to the bottom side; and a diffuser optically connected with all of the at least four indicator LEDs;

wherein the at least four indicator LEDs are arranged on two or more printed circuit boards.

* * * * *